US010185282B2

(12) United States Patent
Lin et al.

(10) Patent No.: US 10,185,282 B2
(45) Date of Patent: Jan. 22, 2019

(54) DISASSEMBLABLE IMAGING APPARATUS

(71) Applicant: AVISION INC., Hsinchu (TW)

(72) Inventors: Chia-Hsin Lin, Hsinchu (TW); Jan-Hsing Kao, Miaoli County (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/799,889

(22) Filed: Oct. 31, 2017

(65) Prior Publication Data

US 2018/0120757 A1 May 3, 2018

(30) Foreign Application Priority Data

Nov. 2, 2016 (TW) ..... 105216693 U

(51) Int. Cl.

*G03G 21/16* (2006.01)
*G03G 15/00* (2006.01)
*G03G 21/18* (2006.01)

(52) U.S. Cl.

CPC ..... *G03G 21/1609* (2013.01); *G03G 15/607* (2013.01); *G03G 15/757* (2013.01); *G03G 21/1647* (2013.01); *G03G 21/1821* (2013.01); *G03G 2215/066* (2013.01); *G03G 2221/1606* (2013.01); *G03G 2221/1687* (2013.01)

(58) Field of Classification Search

CPC ..... G03G 21/1821; G03G 21/1817; G03G 2221/1853; G03G 2221/1861

See application file for complete search history.

(56) References Cited

U.S. PATENT DOCUMENTS 6,330,410 B1 * 12/2001 Okabe ..... G03G 15/0813 399/111
8,706,005 B2 * 4/2014 Okabe ..... G03G 21/1821 399/113
9,280,136 B2 * 3/2016 Horikawa ..... G03G 21/1867

* cited by examiner

*Primary Examiner* — Gregory H Curran

(57) ABSTRACT

A disassemblable imaging apparatus includes a photo sensing assembly, a toner cartridge, and at least one torsion spring. The photo sensing assembly includes a casing and a photosensitive drum. The casing has an accommodating space. The photosensitive drum is installed on the casing and located at a side of the accommodating space. The toner cartridge is detachably located in the accommodating space. The at least one torsion spring is located in the accommodating space. A part of the at least one torsion spring is installed on the casing, and another part of the at least one torsion spring presses a side of the toner cartridge facing away from the photosensitive drum for pushing the toner cartridge toward the photosensitive drum.

8 Claims, 6 Drawing Sheets

DISASSEMBLABLE IMAGING APPARATUS

CROSS-REFERENCE TO RELATED APPLICATIONS

This non-provisional application claims priority under 35 U.S.C. § 119(a) on Patent Application No(s). 105216693 filed in Taiwan, R.O.C. on Nov. 2, 2016, the entire contents of which are hereby incorporated by reference.

TECHNICAL FIELD

The disclosure relates to an imaging apparatus, more particularly to a disassemblable imaging apparatus.

BACKGROUND

The conventional printer is generally divided into the laser printer and the light emitting diode (LED) printer according to the difference of their light source. Comparing the laser printer and the light emitting diode printer, the LED light source has a longer service life and lower power consumption. Moreover, heat generated by the LED light source is relatively low so that the requirements of the heat dissipation component can be reduced, thereby reducing noise while the printer is in operation. In addition, the LED printer has no need to be equipped with a complicated optical structure so that the LED printer has high durability and reliability. The size of the LED printer can be smaller than the size of the laser printer, and more functions can be integrated into the LED printer. Therefore, the LED printer has become the mainstream product.

In detail, an imaging apparatus of a conventional printer includes a photosensitive drum and a toner cartridge. Generally, the traditional photosensitive drum and the traditional toner cartridge are inseparable. In such a design, a distance between the photosensitive drum and the toner cartridge can be controlled precisely so that the imaging quality can be controlled easily. In recent years, with the raise of environmental awareness, some of printer manufacturers start to design a changeable toner cartridge, which is consumable, and let the photosensitive drum, which is not consumable, can be used repeatedly; therefore, the imaging apparatus becomes disassemblable.

SUMMARY

According to an embodiment of the present disclosure, a disassemblable imaging apparatus includes a photo sensing assembly, a toner cartridge, and at least one torsion spring. The photo sensing assembly includes a casing and a photosensitive drum. The casing has an accommodating space. The photosensitive drum is installed on the casing and located at a side of the accommodating space. The toner cartridge is detachably located in the accommodating space. The at least one torsion spring is located in the accommodating space. A part of the at least one torsion spring is installed on the casing, and another part of the at least one torsion spring presses a side of the toner cartridge facing away from the photosensitive drum for pushing the toner cartridge toward the photosensitive drum.

BRIEF DESCRIPTION OF THE DRAWINGS

The present disclosure will become better understood from the detailed description given hereinbelow and the accompanying drawings which are given by way of illustration only and thus are not intending to limit of the present disclosure and wherein.

DETAILED DESCRIPTION

Figure 1:
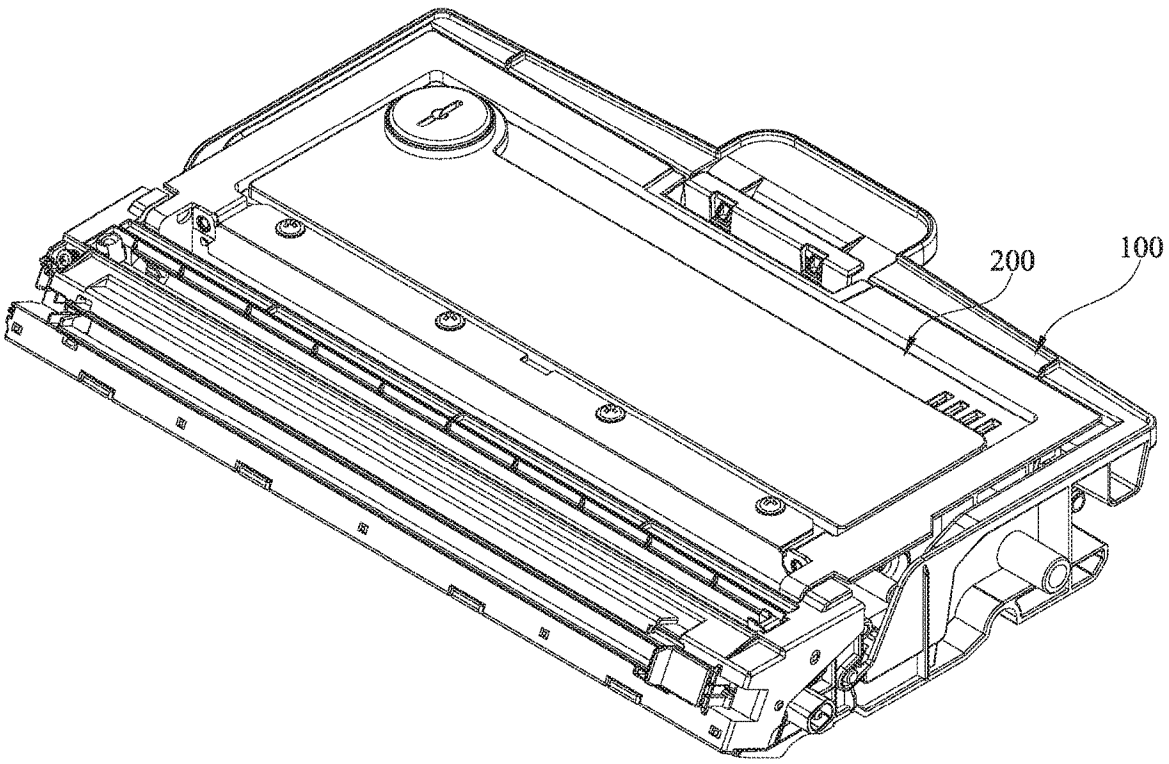
FIG. 1 is a schematic view of an imaging apparatus in an embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
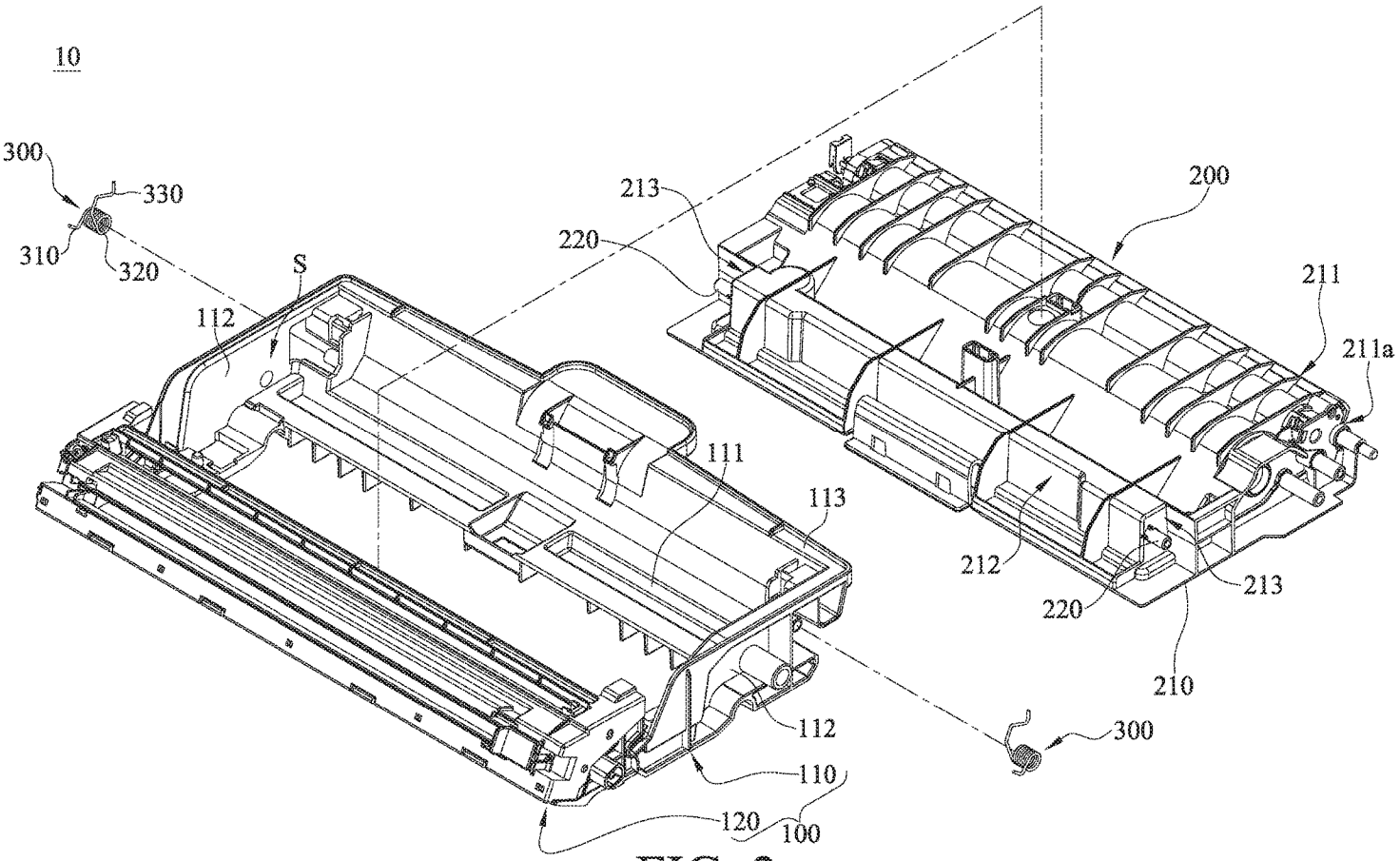
FIG. 2 is an exploded view of the imaging apparatus in FIG. 1.
Figure 3:
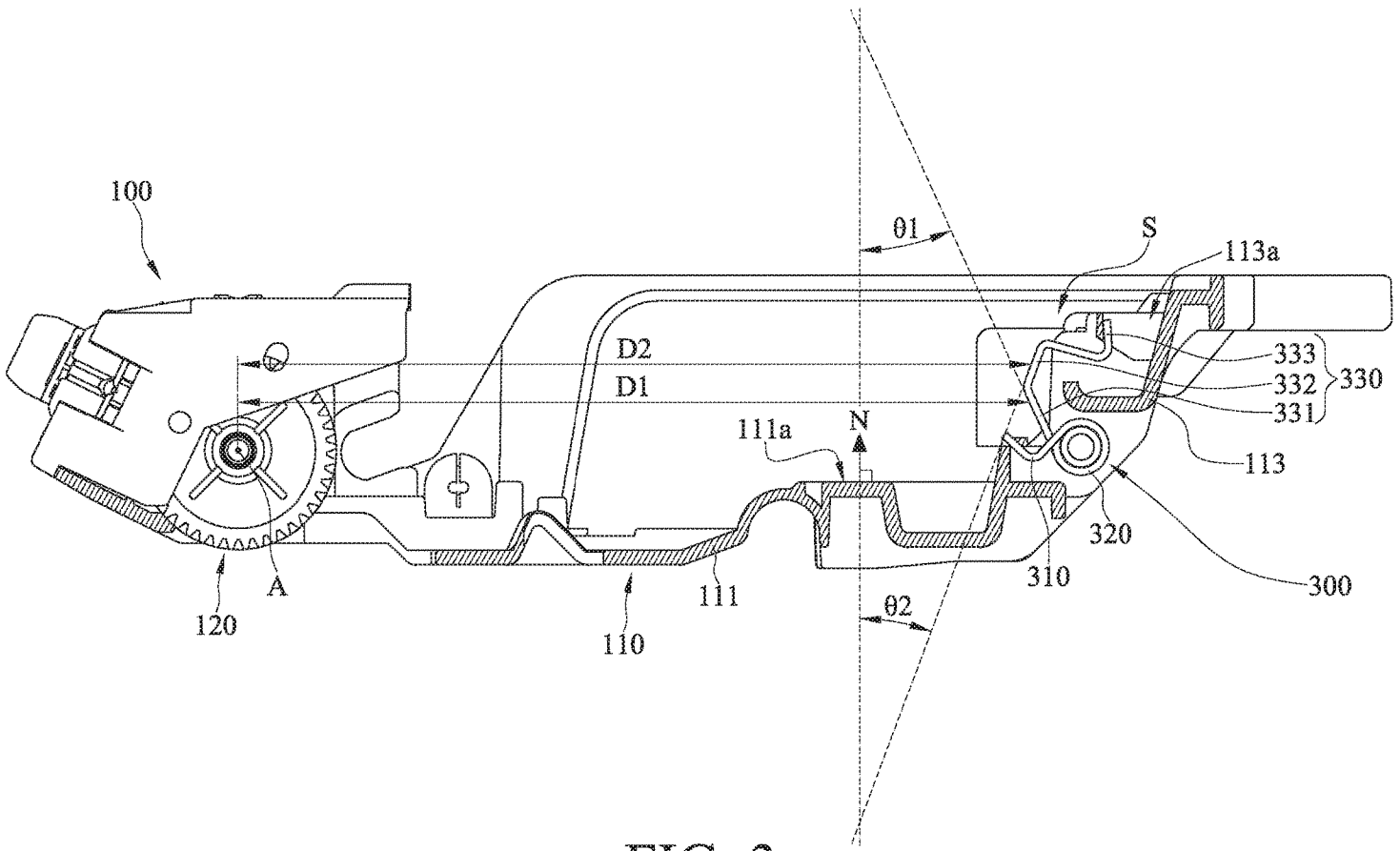
FIG. 3 is a cross-sectional view of the photo sensing assembly and the torsion spring of the imaging apparatus in FIG. 1.

Please refer to FIG. 1 to FIG. 3. FIG. 1 is a schematic view of an imaging apparatus in an embodiment of the present disclosure. FIG. 2 is an exploded view of the imaging apparatus in FIG. 1. FIG. 3 is a cross-sectional view of the photo sensing assembly and the torsion spring of the imaging apparatus in FIG. 1. In this embodiment, a disassemblable imaging apparatus 10 is provided. The disassemblable imaging apparatus 10 includes a photo sensing assembly 100, a toner cartridge 200, and two torsion springs 300.

The photo sensing assembly 100 includes a casing 110 and a photosensitive drum 120. The casing 110 has an accommodating space S. The photosensitive drum 120 is installed on the casing 110 and located at a side of the accommodating space S. In detail, the casing 110 includes a base board 111, two side boards 112, and a back board 113. The two side boards 112 are respectively connected to two sides of the base board 111 which are opposite to each other. The two side boards are connected by the back board 113, and the accommodating space S is defined by the two side boards 112 and the back board 113. In addition, a side of the back board 113 away from the base board 111 has a slide groove 113*a*.

The photosensitive drum 120 is installed on a side of the base board 111 away from the back board 113. In other words, the back board 113 and the photosensitive drum 120 are respectively located at two sides of the accommodating space S which are opposite to each other.

The toner cartridge 200 is detachably installed in the accommodating space S. In other words, the toner cartridge 200 is located between the photosensitive drum 120 and the back board 113. The toner cartridge 200 includes a base body 210 and two press protrusions 220. An internal space of the base body 210 is configured to store toner. The base body 210 has a front surface 211, a back surface 212, and two side surfaces 213. The front surface 211 faces the photosensitive drum 120. The front surface 211 of the base body 210 has a toner outlet 211*a*, and the toner outlet 211*a* is aligned with the photosensitive drum 120 so as to transfer the toner to the paper for printing by the photosensitive drum 120. The back surface 212 faces away from the front surface 211. Two sides of each of the side surfaces 213, which are opposite to each other, are respectively connected to the front surface 211 and the back surface 212. The two press protrusions 220 respectively protrude from the two side surfaces 213 of the base body 210.

The two torsion springs 300 are installed on the casing 110, and at least a part of each of the two torsion springs 300 is located in the accommodating space S. In detail, each of the two torsion springs 300 includes a fixed elastic arm 310, an installing part 320, and a movable elastic arm 330. Since the two torsion springs 300 are symmetric structures, and the two press protrusions are symmetric structures, the following takes one torsion spring 300 and one press protrusion 220 as an illustration in the following paragraphs. The fixed elastic arm 310 and the movable elastic arm 330 are connected by the installing part 320. The installing part 320 is installed on the back board 113 of the casing 110. The fixed elastic arm 310 is fastened to the back board 113 of the casing 110. The movable elastic arm 330 is slidably located in the slide groove 113*a* of the back board 113 so that the movable elastic arm 330 is swingably located on the back board 113 of the casing 110. At least a part of the movable elastic arm 330 is located in the accommodating space S and presses against a side of the press protrusion 220 facing away from the photosensitive drum 120 so as to push the toner cartridge 200 toward the photosensitive drum 120. As a result, the toner outlet 211*a* located at the front surface 211 of base body 210 is moved closer to the photosensitive drum 120.

In the embodiment of the present disclosure, the movable elastic arm 330 pushes the side of the press protrusion 220 facing away from the photosensitive drum 120, but the disclosure is not limited thereto. In other embodiment of the present disclosure, the movable elastic arm 330 pushes the back surface 212 of the base body 210 or other parts of the base body 210 facing away from the photosensitive drum 120 so as to push the base body 210 toward the photosensitive drum 120.

In this embodiment, the movable elastic arm 330 includes a first inclined part 331, a second inclined part 332, and a sliding part 333. The first inclined part 331 is connected to the installing part 320. The first inclined part 331 and the sliding part 333 are connected by the second inclined part 332. The sliding part 333 is slidably located in the slide groove 113*a*. Moreover, the base board 111 has a top surface 111*a* facing the base body 210 of the toner cartridge 200. An extending direction of the first inclined part 331 and a normal direction N of the top surface 111*a* form a first acute angle $\theta_1$. An extending direction of the second inclined part 332 and the normal direction N of the top surface 111*a* form a second acute angle $\theta_2$. In detail, a first horizontal distance D1 between the second inclined part 332 and an axis A of the photosensitive drum 120 decreases along the second inclined part 332 from a portion of the second inclined part 332, being closer to the sliding part 333, to another portion of the second inclined part 332, being further away from the sliding part 333. In other words, a horizontal distance between the portion of the second inclined part 332, being closer to the sliding part 333, and the axis A of the photosensitive drum 120 is longer than a horizontal distance between the portion of the second inclined part 332, being further away from the sliding part 333, and the axis A of the photosensitive drum 120. Therefore, when the toner cartridge 200 is installed into the accommodating space S, the second inclined part 332 is pushed away from the photosensitive drum 120, and the toner cartridge 200 is guided by the second inclined part 331 to be smoothly installed into the accommodating space S. Moreover, a second horizontal distance D2 between the first inclined part 331 and the axis A of the photosensitive drum 120 increases along the first inclined part 331 from a portion of the first inclined part 331, being closer to the sliding part 333, to another portion of the first inclined part 331, being further away from the sliding part 333. In other words, a horizontal distance between the position of the first inclined part 331, being closer to the sliding part 333, and the axis A of the photosensitive drum 120 is shorter than a horizontal distance between the position of the first inclined part 331, being further away from the sliding part 333, and the axis A of the photosensitive drum 120. Therefore, after the toner cartridge 200 is installed into the accommodating space S, the side of the press protrusion 220 away from the photosensitive drum 120 is pressed by the first inclined part 331 so that the toner cartridge 200 is pushed toward the base board 111 and the photosensitive drum 120.

In this embodiment, the number of the press protrusion 220 is two, and the number of the torsion spring 300 is two, but the disclosure is not limited thereto. In other embodiments of the present disclosure, the number of the press protrusion 220 is one, the number of the torsion spring 300 is one, and the press protrusion 220 and the torsion spring 300 are located at the same side of the toner cartridge 200 or at the center of the toner cartridge 200.

In addition, in this embodiment, the fixed elastic arm 310, the installing part 320, and the movable elastic arm 330 of the torsion spring 300 are installed on the back board 113 of the casing 110, but the installation locations of the fixed elastic arm 310, the installing part 320, and the movable elastic arm 330 are not the limitation to the present disclosure. In other embodiments of the present disclosure, the fixed elastic arm 310 is fastened to the base board 111, the installing part 320 is installed on the back board 113, and the movable elastic arm 330 is swingably disposed on the back board 113.

Figure 4:
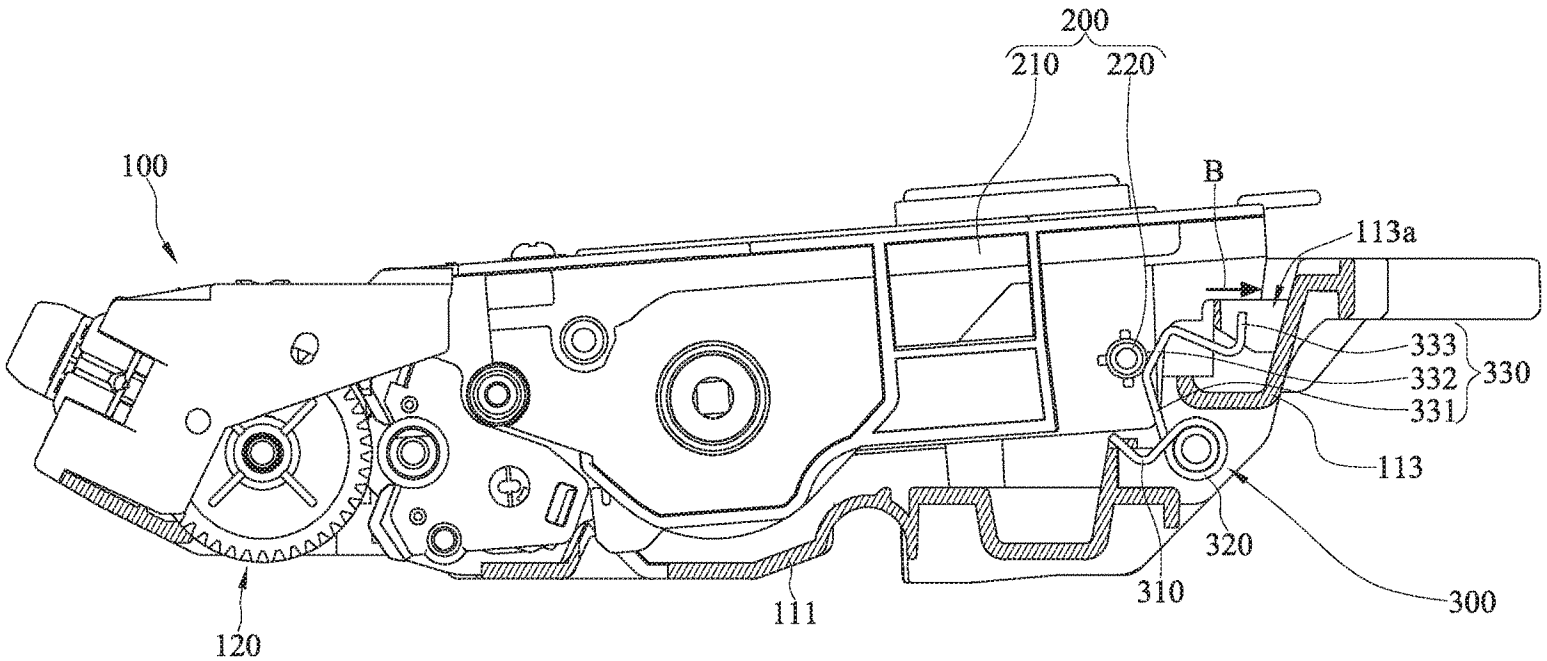
FIG. 4 is a cross-sectional view of a press protrusion of the toner cartridge pressed by a second inclined part in FIG. 2.
Figure 5:
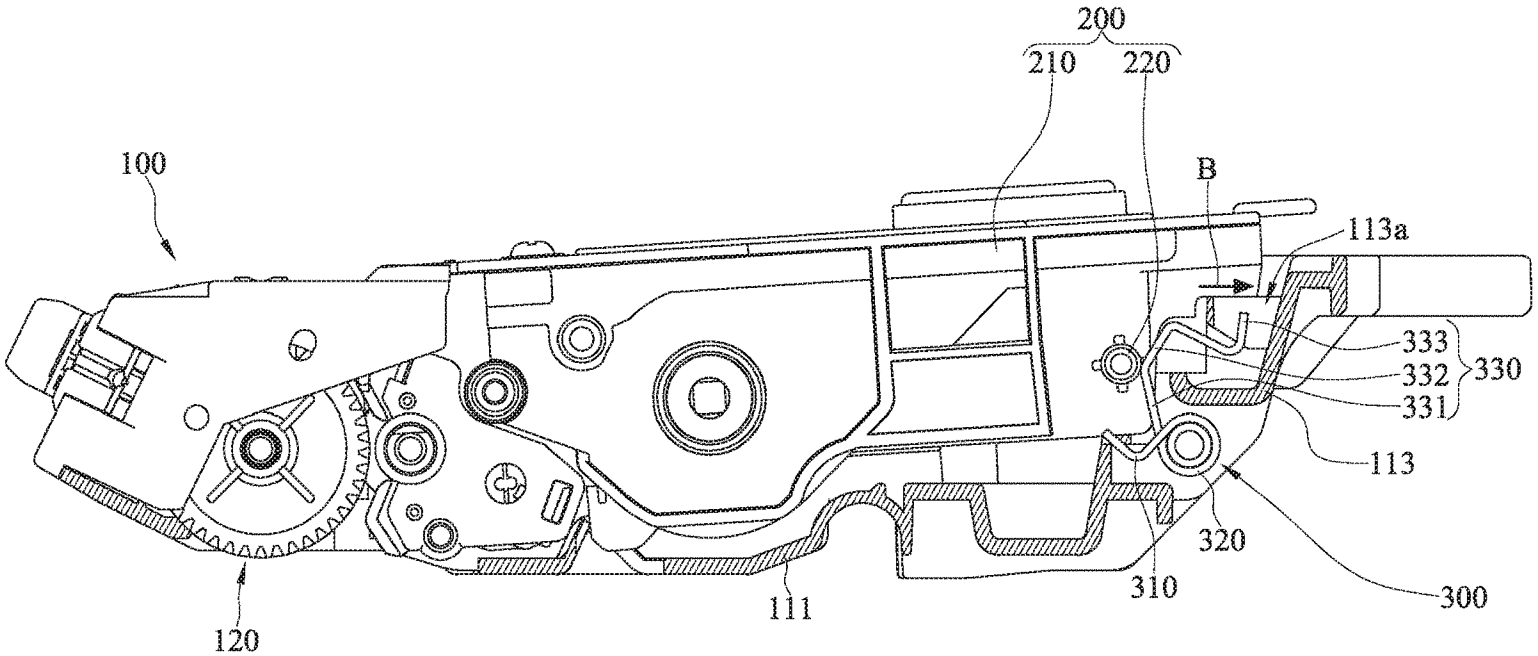
FIG. 5 is a cross-sectional view of the press protrusion of the toner cartridge pressed by a junction of a first inclined part and the second inclined part in FIG. 2.
Figure 6:
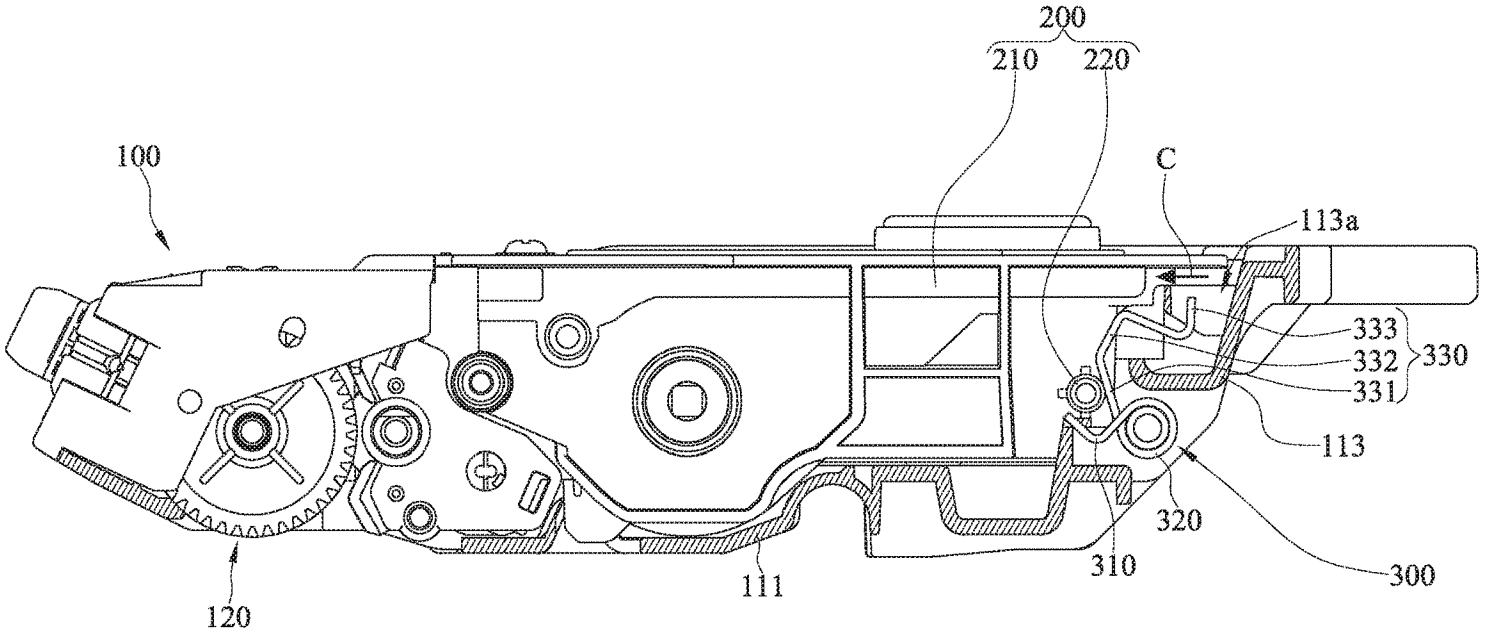
FIG. 6 is a cross-sectional view of the press protrusion of the toner cartridge pressed by the first inclined part in FIG. 2.

Please refer to FIG. 4 to FIG. 6. FIG. 4 is a cross-sectional view of a press protrusion of the toner cartridge pressed by a second inclined part in FIG. 2. FIG. 5 is a cross-sectional view of the press protrusion of the toner cartridge pressed by a junction of a first inclined part and the second inclined part in FIG. 2. FIG. 6 is a cross-sectional view of the press protrusion of the toner cartridge pressed by the first inclined part in FIG. 2. As shown in FIG. 4, when the press protrusion 220 of the toner cartridge 200 is moved toward the base board 111 along the second inclined part 332, the press protrusion 220 pushes the second inclined part 332 away from the photosensitive drum 120 along a direction B, and the press protrusion 220 is also moved toward the base board 111 with a guidance of the second inclined part 331.

Then, as shown in FIG. 5, the press protrusion 220 of the toner cartridge 200, which is guided by the second inclined part 332, slides along the second inclined part 332 to a junction of the first inclined part 331 and the second inclined part 332, and the press protrusion 220 pushes the second inclined part 332 away from the photosensitive drum 120 along the direction B. Then, as shown in FIG. 6, after the press protrusion 220 slides over the second inclined part 332, the movable elastic arm 330 of the torsion spring 300 rebounds back toward along the direction C so that the first inclined part 331 presses against the side of the press protrusion 220 away from the photosensitive drum 120. As a result, the toner cartridge 200, being pushed by the first inclined part 332, steadily presses against the base board 111 and moves toward the photosensitive drum 120.

According to the disassemblable imaging apparatus in the above embodiment of the present disclosure, the movable elastic arm of the torsion spring is swingably disposed in the accommodating space and presses against the side of the toner cartridge facing away from the photosensitive drum so as to push the toner cartridge toward and close to the photosensitive drum. Therefore, except for achieving the environmental requirements for the disassemblable imaging apparatus, the distance between the photosensitive drum and the toner cartridge in the disassemblable imaging apparatus is controlled precisely so as to improve the imaging quality of the disassemblable imaging apparatus.

In addition, the movable elastic arm of the torsion spring is divided into the first inclined part and the second inclined part which have different inclined directions. Therefore, the toner cartridge is not only smoothly disposed into the accommodating space but also tightly fitted into the accommodating space.

What is claimed is:

1. A disassemblable imaging apparatus, comprising:

a photo sensing assembly comprising a casing and a photosensitive drum, the casing having an accommodating space, and the photosensitive drum being installed on the casing and located at a side of the accommodating space;

a toner cartridge detachably located in the accommodating space; and at least one torsion spring located in the accommodating space, a part of the at least one torsion spring being installed on the casing, and another part of the at least one torsion spring pressing against a side of the toner cartridge facing away from the photosensitive drum in order to push the toner cartridge toward the photosensitive drum, wherein the at least one torsion spring comprises a fixed elastic arm, an installing part, and a movable elastic arm, the fixed elastic arm and the movable elastic arm are connected by the installing part, the installing part is installed on the casing, the fixed elastic arm is fastened to the casing, the movable elastic arm is swingably disposed on the casing, and the movable elastic arm presses against the side of the toner cartridge facing away from the photosensitive drum.

2. The disassemblable imaging apparatus according to claim 1, wherein the casing comprises a base board, two side boards, and a back board, the two side boards are connected to two sides of the base board which are opposite to each other, the back board is connected to the two side boards, the accommodation space is defined by the two side boards and the back board, the photosensitive drum is installed on a side of the base board away from the back board, the installing part is installed on the back board, the fixing elastic arm is fastened to the casing, and the movable elastic arm is slidably disposed on the back board.

3. The disassemblable imaging apparatus according to claim 2, wherein the back board has a slide groove, the movable elastic arm comprises a first inclined part, a second inclined part, and a sliding part, the first inclined part is connected to the installing part, the first inclined part and the sliding part are connected by the second inclined part, the sliding part is slidably disposed in the slide groove, a first horizontal distance between the second inclined part and an axis of the photosensitive drum decreases along the second inclined part from a portion of the second inclined part being closer to the sliding part to another portion of the second inclined part being further away from the sliding part, and a second horizontal distance between the first inclined part and the axis of the photosensitive drum increases along the first inclined part from a portion of the first inclined part being closer to the sliding part toward a portion of the first inclined part being further away from the sliding part.

4. The disassemblable imaging apparatus according to claim 3, wherein the toner cartridge comprises a base body and at least one press protrusion, the press protrusion protrudes from the base body, and a side of the press protrusion away from the photosensitive drum is pressed by the first inclined part of the movable elastic arm.

5. The disassemblable imaging apparatus according to claim 4, wherein the base body has a front surface, a back surface, and at least one side surface, the front surface faces the photosensitive drum, the back surface faces away from the front surface, two opposite sides of the side surface are respectively connected to the front surface and the back surface, and the press protrusion protrudes from the side surface of the base body.

6. The disassemblable imaging apparatus according to claim 5, wherein each of numbers of the at least one side surface, the at least one press protrusion, and the at least one torsion spring is two, the two press protrusions respectively protrudes from the two side surfaces, and the two first inclined parts respectively press against the two press protrusions.

7. The disassemblable imaging apparatus according to claim 5, wherein the front surface of the base body has a toner outlet, and the toner outlet is aligned with the photosensitive drum.

8. The disassemblable imaging apparatus according to claim 3, wherein the base board has a top surface, the top surface faces the toner cartridge, a first acute angle is formed between an extending direction of the first inclined part and a normal direction of the top surface, and a second acute angle is between an extending direction of the second inclined part and the normal direction of the top surface.

* * * * *